US006446347B1

(12) United States Patent
Springer

(10) Patent No.: US 6,446,347 B1
(45) Date of Patent: Sep. 10, 2002

(54) ALWAYS NORMAL BOW SIGHT

(76) Inventor: Eric C. Springer, 167 Burtis Point Rd., Auburn, NY (US) 13021

( * ) Notice: Subject to any disclaimer, the term of this patent is extended or adjusted under 35 U.S.C. 154(b) by 0 days.

(21) Appl. No.: 09/491,863

(22) Filed: Jan. 26, 2000

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS

| | | | | | |
|---|---|---|---|---|---|
| 2,959,860 | A | * | 11/1960 | Kowalcyk | 33/265 |
| 3,487,548 | A | * | 1/1970 | Frydenlund | 33/265 |
| 4,142,297 | A | * | 3/1979 | Altier | 33/265 |
| 4,153,999 | A | * | 5/1979 | O'Steen | 33/265 |
| 4,167,333 | A | * | 9/1979 | Young et al. | 33/265 |
| 4,669,196 | A | * | 6/1987 | Kersey | 33/265 |
| 5,092,052 | A | * | 3/1992 | Godsey | 33/265 |
| 5,465,491 | A | * | 11/1995 | Thell | 33/265 |
| 5,524,601 | A | * | 6/1996 | Slates et al. | 124/87 |
| RE36,266 | E | * | 8/1999 | Gibbs | 33/265 |
| 6,119,672 | A | * | 9/2000 | Closson | 124/87 |
| 6,134,794 | A | * | 10/2000 | Raukola | 33/265 |

* cited by examiner

*Primary Examiner*—G. Bradley Bennett
(74) *Attorney, Agent, or Firm*—Bernhard P. Molldrem, Jr.

(57) ABSTRACT

The bow sight may be adjusted for elevation while maintaining the sight normal to an archer's line of sight. The bow sight of the invention enables the elevation block to traverse an arc, when being adjusted for elevation, that has a radius that approximates the distance from the elevation block to the archer's eye. The bow sight may also include a quick release carrier that maintains a predetermined alignment of the sight even through disassembly and reassembly. The bow sight may be disassembled for storage and reassembled without affecting the alignment of the sight. The frame of the bow sight may be easily manufactured by extruding and machining.

14 Claims, 8 Drawing Sheets

ALWAYS NORMAL BOW SIGHT

BACKGROUND OF THE INVENTION

1. Field of the Invention

This invention is related to a sight for an archery bow. In particular, -this invention is directed to a sight for an archery bow that maintains the axis of the sight normal to the archer's sighting eye.

2. Description of Related Art

FIG. 1 shows a perspective view of a conventional bow sight 10. The bow sight 10 is attached to a bow (not shown) by a support bar 12. The support bar 12 supports a frame 14 which retains a lead screw 16. The lead screw 16 is connect to a knurled adjusting knob 18. The lead screw 16 is threadably entrained within an elevation block 20 that may be moved upward or downward, as shown by arrow A, by rotating the knurled knob 18. The elevation block 20 is connected to a sighting device 22 through a windage block 28. Therefore, by turning the adjusting knob 18, the sighting device 22 may be moved upward or downward to adjust the elevation of flight of an arrow from the bow.

The elevation block 20 also includes a transversely extending screw 24 that is attached to a knurled knob 26. The transversely extending screw 24 is threadably entrained by the windage block 28. The windage block 28 is connected to the sighting device 22. An archer may adjust the sighting device 22 by rotating knurled knob 26 and moving the sighting device 22 in the direction of arrow B to adjust for wind.

One of the problems with the conventional bow sight that was discovered by the inventor is that an archer's line of sight through the sighting device 22 may not be normal to the sighting device 22. FIG. 2 shows an archer 30 using a conventional sighting device 10 to sight a target 32. FIG. 2 shows that the axis $\alpha$ of the sighting device of the bow sight 10 does not coincide with the line of sight $\beta$ of the archer 30 to the target 32. The angle $\gamma$ between the axis a and the line of sight $\beta$ causes error in the sighting of an arrow to the target 32. In the example shown in FIG. 2, the archer's line of sight $\beta$ falls on the target 32 at a point that is lower than the point on the target 32 upon which the axis $\alpha$ of the sighting device of the bow sight 10 falls. Thus, the archer's line of sight $\beta$ does not provide a correct sight that corresponds to the axis $\alpha$ of the sighting device of the bow sight 10.

An exemplary sighting device of the bow sight 10 is a lens 34 carrying a filament 36 as shown in FIGS. 1, 3 and 4. FIG. 3 shows an exemplary sight picture of an archer 30 when the axis $\alpha$ of the sighting device 22 does not coincide with the line of sight $\beta$ of the archer 30. With this sight picture a portion of the length of the filament 36 is visible to the archer. Therefore, the filament 36 is not focused and appears to have a height h that is greater than the radius r of the filament 36.

FIG. 4 shows a correct sight picture. In particular, the sight picture shown in FIG. 4 is provided when the line of sight $\beta$ of the archer coincides with the axis $\alpha$ of the sighting device 22. The sight picture of FIG. 4 provides an accurate aim to a target while the sight picture of FIG. 3 does not provide an accurate aim.

SUMMARY OF THE INVENTION

An exemplary embodiment of a bow sight in accordance with the present invention provides a frame and an elevation block that cooperate to maintain the approximate coincidence of the axis $\alpha$ of the sighting device 22 with the line of sight $\beta$ of an archer. An exemplary embodiment of the invention maintains this coincidence even when the bow sight is adjusted for elevation. The exemplary embodiment of the bow sight of the present invention has a frame with radiused guide ways through which the elevation block of the sighting device travels when being adjusted for elevation. In other words, even though the elevation and windage of the sighting device may be adjusted, the sighting device is always normal to the line of sight of the archer. The radius of the radiused guide ways approximately corresponds to the distance from the archer's eye to the sighting device 22 on the bow sight 10.

Another exemplary embodiment of the present invention includes a quick release carrier for the sighting device. The quick release carrier maintains the alignment of the sighting device with the archer's line of sight. Therefore, the exemplary bow sight of the invention may have the sighting device removed from the bow sight for storage and the bow sight may be reassembled without affecting the alignment of the sighting device with the archer's line of sight when the sighting device is removed and replaced.

Yet another exemplary embodiment of the bow sight in accordance with the present invention also includes a frame that is of a configuration that may be extruded prior to machining. Conventional bow sight frames are difficult to manufacture. By contrast, the frame of the bow sight in accordance with the present invention may be easily manufactured by extruding and subsequent machining. The frame is also unique in that it completely encloses a void or hollow space.

These and other features and advantages of this invention are described in or are apparent from the following detailed description of the preferred embodiments.

BRIEF DESCRIPTION OF THE DRAWINGS

The preferred embodiments of this invention will be described in detail with reference to the following figures, wherein.

DETAILED DESCRIPTION OF THE PREFERRED EMBODIMENTS

Figure 1:
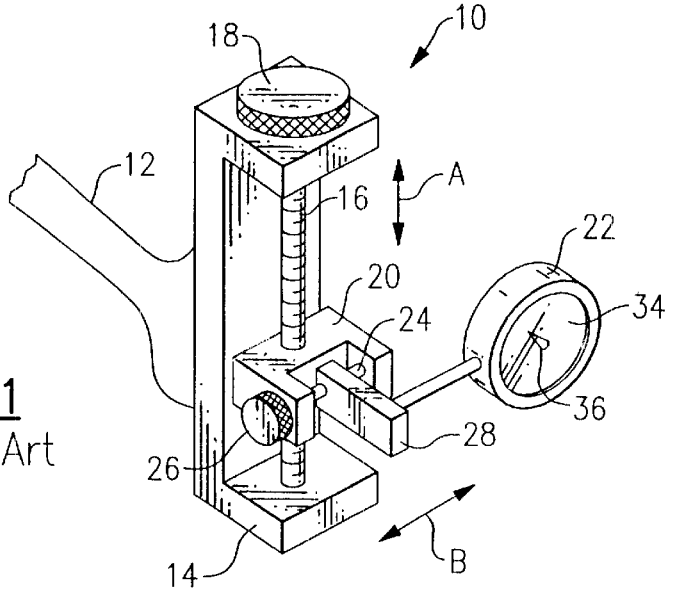
FIG.1 Prior Art
FIG. 1 is a perspective view of a conventional bow sight.
Figure 2:
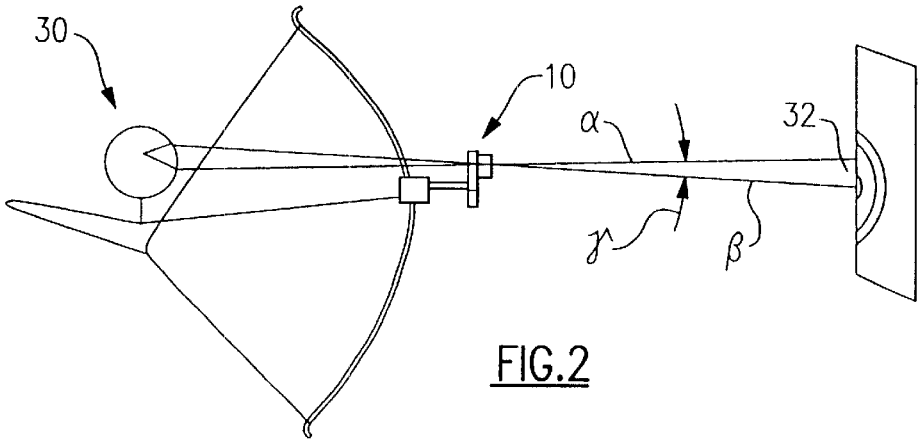
FIG. 2 is an elevation view of an archer aiming a bow with a bow sight at a target where the bow sight has an axis that does not coincide with the line of sight of the archer.
Figure 3:
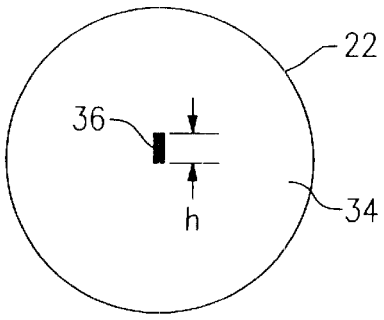
FIG. 3 is a sight picture of a sighting device with an axis that does not coincide with the line of sight of the archer.
Figure 4:
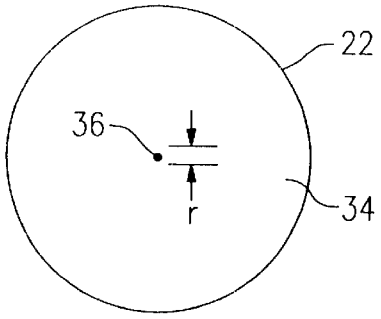
FIG. 4 shows a sight picture wherein the axis of the sighting device coincides with the line of sight of the archer.
Figure 5:
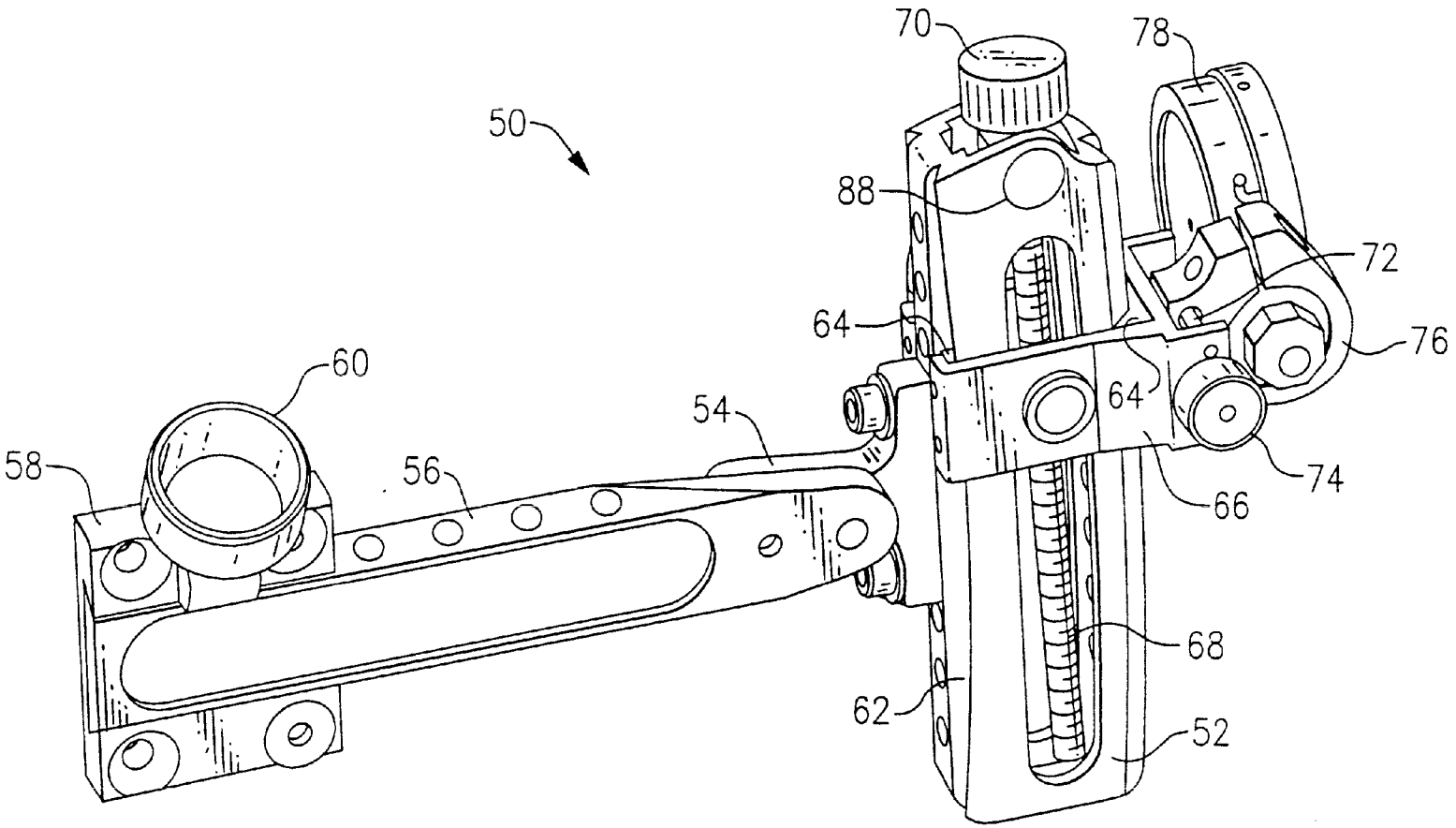
FIG. 5 shows a perspective view of an exemplary embodiment of a bow sight in accordance with the present invention.
Figure 6:
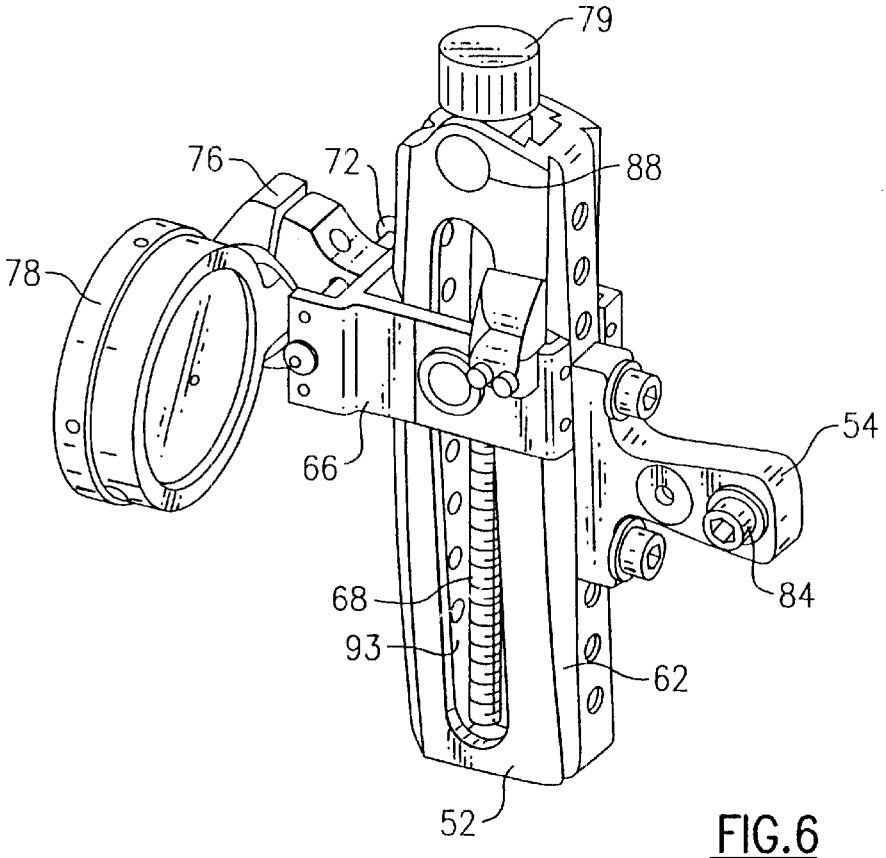
FIG. 6 shows a perspective view of a portion of the exemplary bow sight shown of FIG. 5.

FIGS. 5 and 6 show perspective views of an exemplary embodiment of a bow sight 50 in accordance with the present invention. The bow sight 50 includes a frame 52, a concentricity adjustment block 54 attached to the frame 52, and a dovetail 56 attached to the concentricity adjustment block 54. A dovetail block 58 slidably receives the dovetail 56. The dovetail block 58 is attached to a bow (not shown). The dovetail block 58 threadably receives a screw 60 that operates to clamp the dovetail 56 in position within the dovetail block 58.

The frame 52 includes radiused guide ways 62 that receive bearings 64 of an elevation block 66. The frame 52 also pivotably engages a threaded rod 68 attached to an elevation adjustment knob 70 via a pivot block 88. The threaded rod 68 threadably engages the elevation block 66 and determines the vertical position of the elevation block 66 along the length of the frame 52.

The elevation block 66 also engages a transversely extending screw (not shown) that is attached to a windage adjustment knob 74. The transverse extending screw threadably engages a horizontal slide 76. The horizontal slide 76 is supported on rods 72 and supports a sighting device 78.

Figure 7:
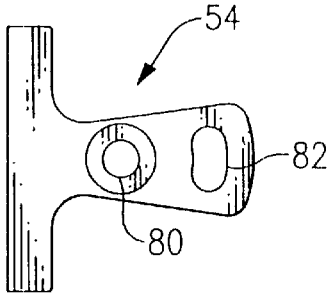
FIG. 7 shows a plan view of a concentricity adjustment block of the exemplary bow sight of FIG. 5.

FIG. 7 shows a plan view of the concentricity adjustment block 54. The concentricity adjustment block 54 includes a pivot hole 80 and an arcuate slot 82. The dovetail 56 pivots about the pivot hole 80. A set screw 84 is threadably engaged by the dovetail 56. The position of the set screw 85 in the arcuate slot 82 determines the angle of the dovetail 56 with respect to the concentricity adjustment block 54 and the frame 52. In this manner, the radius of the guide ways 62 may be aligned to approximately intersect an archer's eye.

The archer also may adjust the position of the dovetail 56 within the dovetail block 58 such that the length of the radius of the guide ways 62 substantially coincide with the distance from the frame to the archer's eye. For example, the frame 52 may include radiused guide ways 62 that circumscribe an arc with a 31-inch radius. The archer may install this exemplary bow sight on the bow and position the dovetail 56 within the dovetail block 58 such that the archer's eye is approximately 31 inches from the frame 52. The archer may then adjust the angle of the frame 52 with the concentricity adjustment block 54 by loosening the set screw 84 and rotating the frame 52 until the radius of the guide slots 62 approximately intersect the archer's eye. The user then tightens the set screw 84 to lock the dovetail 56 relative to the frame 52.

FIGS. 8–11 show an exemplary embodiment of a frame 52 in accordance with the present invention. The frame 52 includes radiused guideways 62 on both the distal (front) ad proximal (rear) sides. As explained earlier, the radiused guide ways 62 circumscribe an arc having a radial length that substantially corresponds with the distance from an archer's eye to the frame 52. The frame includes a pivot hole 86 that receives a pivot block 88 (shown in FIGS. 5 and 6). The pivot block 88 operates as a bearing within the frame 52 and threadably supports the threaded rod 68. The frame 52 also includes mounting holes 90 that are spaced vertically along the length of the frame 52 to cooperate with corresponding mounting holes in the concentricity adjustment block 54. The exemplary frame 52 also includes a radiused slot 92 that receives a portion of the elevation block 66 that pivotably engages the threaded rod 68.

Figure 10:
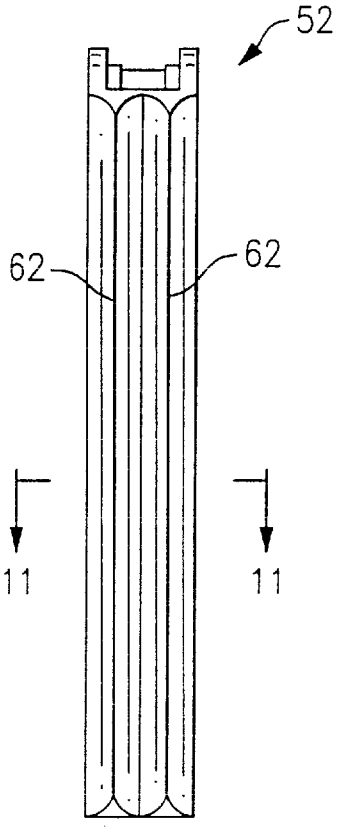
FIG. 10 shows a front view of the frame of FIG. 8.
Figure 9:
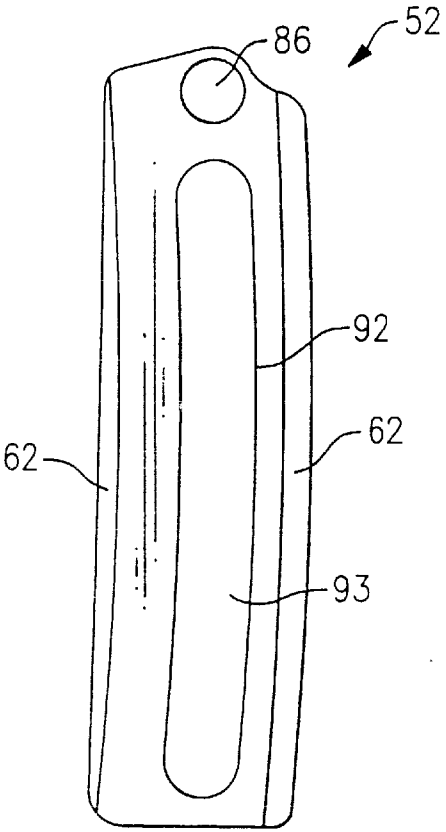
FIG. 9 shows a side elevation view of the frame of FIG. 8.
Figure 8:
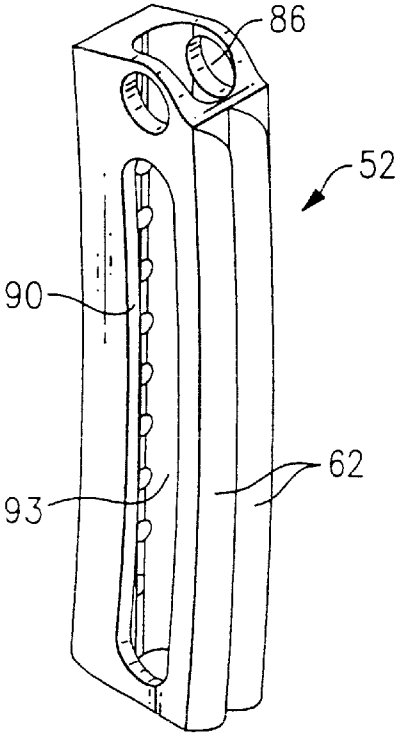
FIG. 8 shows a perspective view of the frame of the exemplary embodiment of the bow sight of FIG. 5.
Figure 11:
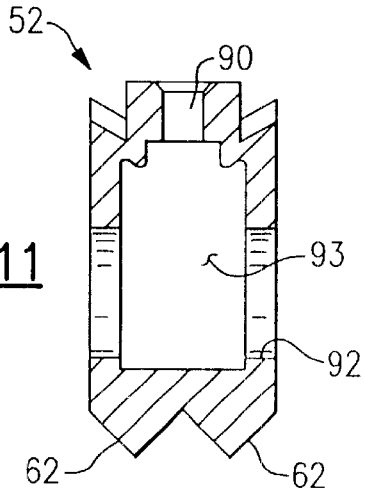
FIG. 11 shows a sectional view taken along lines 11—11 through the frame of FIG. 10.

FIG. 11 shows a sectional view of the frame 52 taken along line 11—11 of FIG. 10. The section of the frame 52 is substantially the same form throughout the height of the frame 52. Therefore, the exemplary frame 52 may be easily manufactured by extruding a frame having the cross section shown in FIG. 11 and subsequently machining the pivot hole 86, the mounting holes 90, the slot 92 and the guide ways 62. The frame 52 is also unique in that it completely encloses a void 93.

Figure 12:
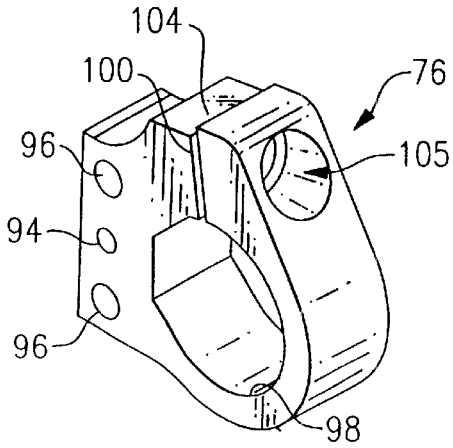
FIG. 12 shows a perspective view of the horizontal slide of the exemplary bow sight of FIG. 5.

FIG. 12 shows a perspective view of the horizontal slide 76 of the exemplary bow sight of FIG. 5. The horizontal slide 76 includes a threaded aperture 94 that threadably engages the transversely extending screw. The horizontal slide 76 also includes apertures 96 that are adapted to slidably engage rods 72. In this manner, the rods 72 are slidably received within apertures 96 and, therefore, support the horizontal slide 76. The transversely extending screw threadably engages the threaded hole 94 to transversely position the horizontal slide 76 with respect to the elevation block 66.

The horizontal slide 76 has a horizontal, transverse receptacle aperture 98 and a slot 100 that extends through the wall of the slide 76. The horizontal slide 76 also includes a threaded aperture 104 on one side of the slot 100 and a non-threaded aperture 105 on the other side of the slot 100. The apertures 104 and 105 are adapted to receive a threaded fastener, i.e., screw 109, to squeeze the slot 100 and to tighten the aperture 98 about the scope block 102 to look the scope block 102 in place when positioned in the receptacle aperture 98.

Figure 13:
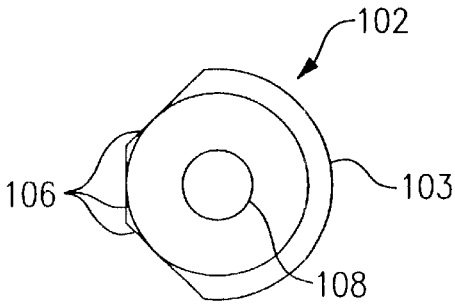
FIG. 13 shows a plan view of the scope block of the exemplary bow sight of FIG. 5.
Figure 14:
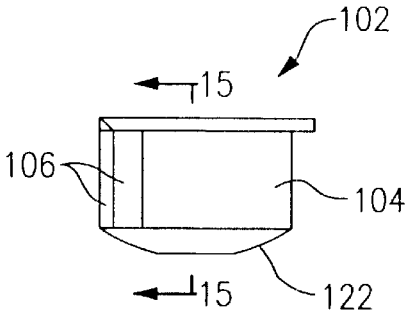
FIG. 14 shows a plan view of the scope block of FIG. 13.

The scope block 102 has an outer circumferential surface that includes a circular surface 103 that transitions into a series of angled surfaces 106. In the exemplary scope block shown in FIG. 13, the angled surfaces 106 are hexagonal. The outer surfaces 103 and 106 mate with the internal surface of the aperture 98 within the horizontal slide 76. The mating of the surfaces 103 and 106 with the internal surface of the aperture 98 of the horizontal slide 76 ensures that the relative position of the scope block with respect to the axis of the aperture 98 and the axis of an internal aperture 108, that extends transversely through the scope block 102, do not change. In this manner, the screw fastener 109 in the threaded apertures 104 and 105 may be loosened or tightened and the scope block 102 may be removed and installed repeatedly in the horizontal slide 76 without affecting the orientation of the scope block 102 with the horizontal slide 76.

Figure 20:
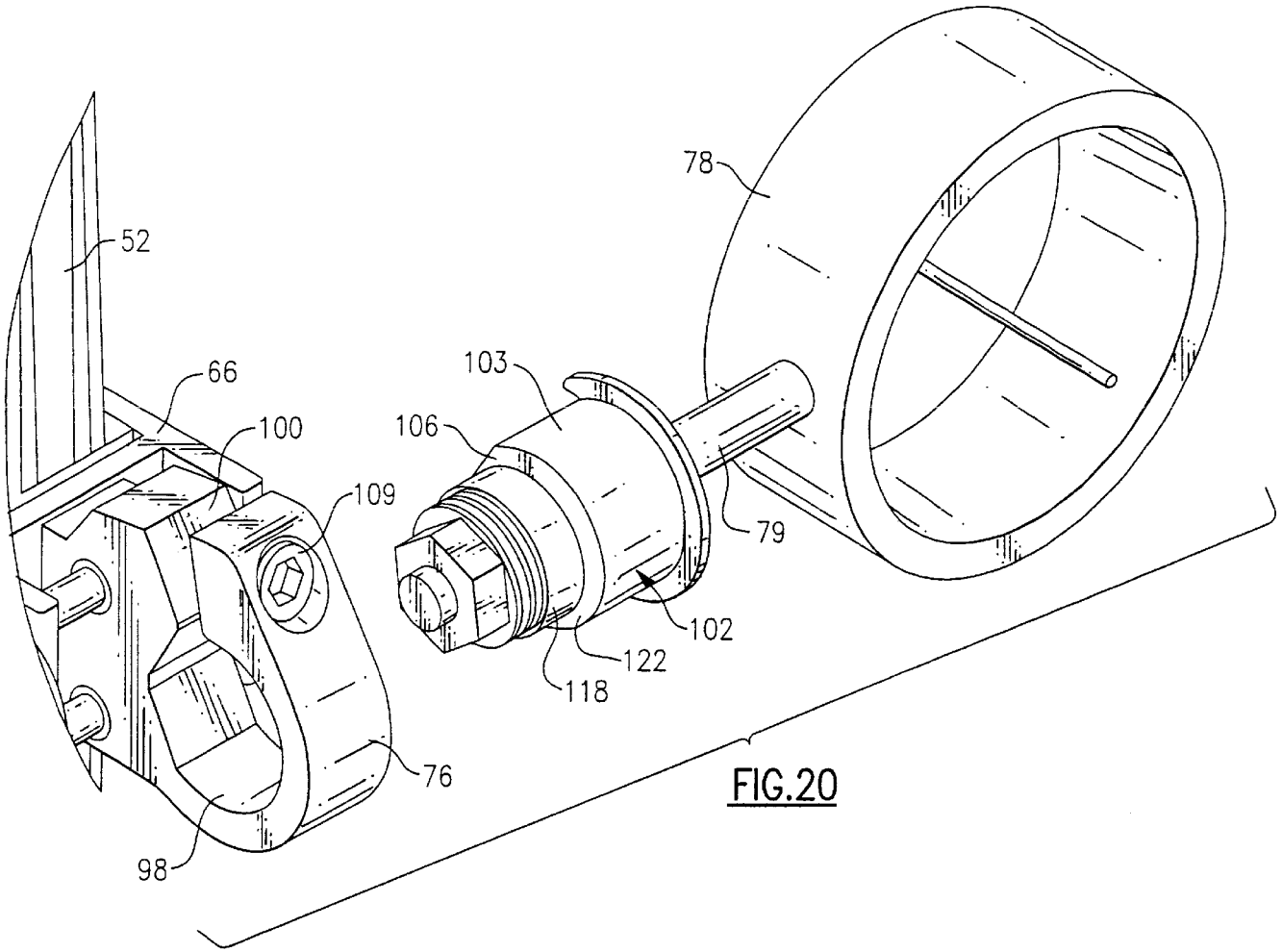
FIG. 20 is an assembly view of the horizontal slide and sight block of an embodiment of the invention.

FIG. 20 is an assembly view showing the scope block 102, with its generally cylindrical surface 103 and flat surface(s) 106, and the mating internal surfaces of the receptacle aperture 98 of the horizontal slide 76.

Figure 15:
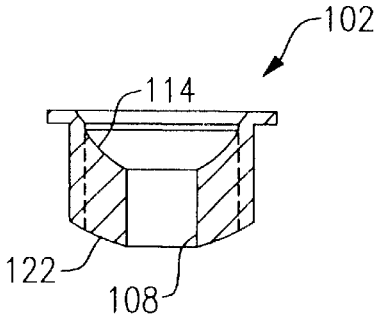
FIG. 15 shows a sectional view taken along line 15—15 through the scope block of FIG. 14.
Figure 16:
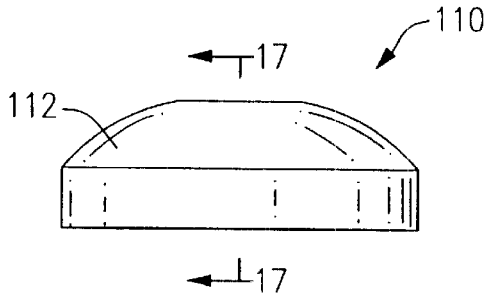
FIG. 16 shows a plan view of the pivot nut of the exemplary bow sight of FIG. 5.
Figure 17:
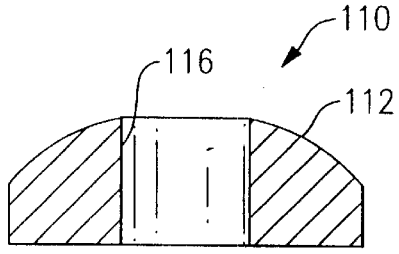
FIG. 17 shows a sectional taken along line 17—17 through the pivot nut of FIG. 16.

FIGS. 16 and 17 show the pivot nut 110 of the exemplary bow sight 50. The pivot nut 110 has a convex surface 112 that is adapted to substantially mate with a concave surface 114 of the scope block 102 shown in FIG. 15. The pivot nut 110 also includes an internally threaded aperture 116.

Figure 18:
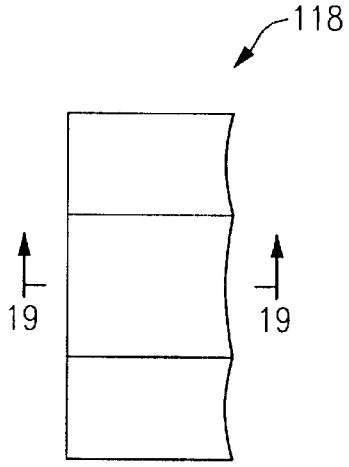
FIG. 18 shows a plan view of the radius nut of the exemplary bow sight of FIG. 5.
Figure 19:
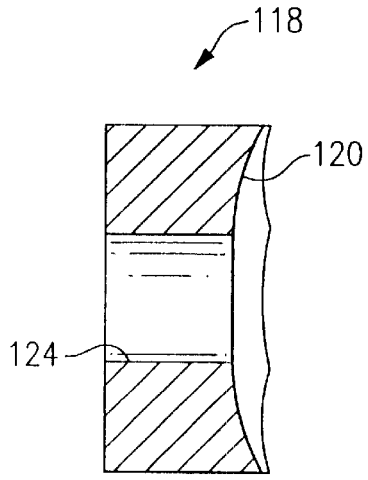
FIG. 19 shows a sectional view taken along line 19—19 through the radius nut of FIG. 18.

FIGS. 18 and 19 show the radius nut 118 of the exemplary bow sight 50. The radius nut 118 includes a concave surface 120 that is adapted to mate with a curved surface 122 on the scope block 102 shown in FIG. 15. The radius nut 118 also optionally includes an internally threaded aperture 124.

Figure 21:
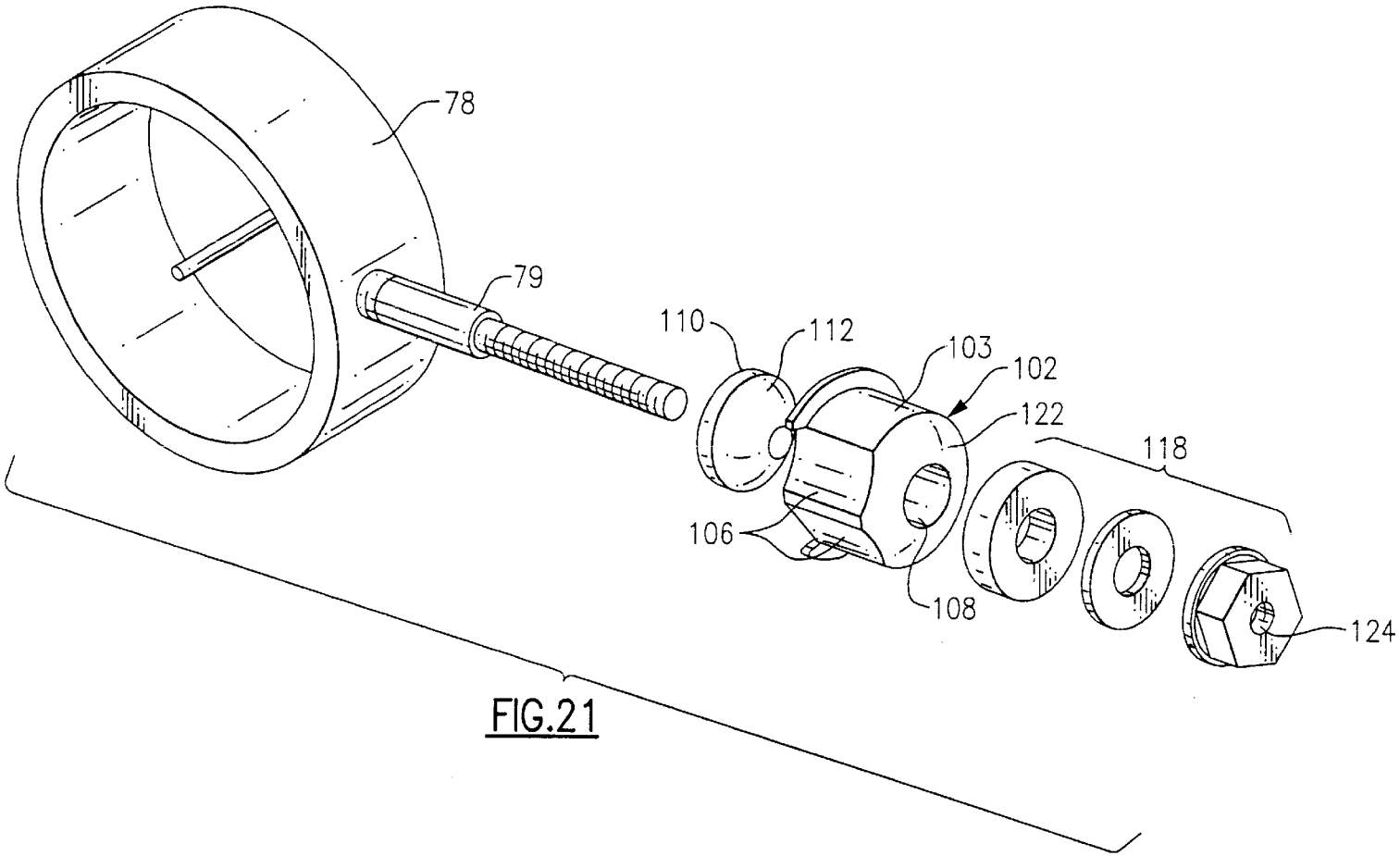
FIG. 21 is an exploded assembly view of the sight block and sighting device of an embodiment of the invention.

The scope block 102, pivot nut 110 and the radius nut 118 together provide an assembly that supports a threaded stud 79 extending from the sighting device 78 (see FIG. 21). The assembly cooperates with the horizontal slide 76 to provide a quick release carrier that enables the sighting device 76 to be disconnected from the bow sight and reconnected without affecting the alignment of the sighting device in the bow sight.

The bow sight is assembled by first positioning the scope block 102 into the horizontal slide 76 and locking the scope block into position. The scope block is arranged as shown in the assembly view of FIG. 21. Next the internally threaded aperture 116 of the pivot nut 110 is threaded onto the stud 79 of the sighing device such that the convex surface 112 faces away from the sighting device 78. Next, the aperture 108 of the scope block 102 receives the stud and the concave surface 114 abuts the convex surface 112 of the pivot nut 110. Next, the internally threaded aperture 124 of the radius nut 118 receives the threaded stud of the sighting device 78 and the radius nut 118 is threaded onto the threaded stud until the concave surface 120 of the radius nut 118 abuts the convex surface 122 of the scope block 102. The alignment of the sighting device 78 is then adjusted until the axis of the sighting device 78 substantially coincides with the line of sight of the archer. After the line of sight and the axis of the sighting device 78 are aligned, the radius nut 118 is tightened against the pivot nut 110 such that the scope block 102, the pivot nut 110 and the radius nut 118 are locked in relation to each other and in relation to the threaded stud of the sighting device 78. The sighting device 78 may also be realigned by loosening the radius nut 118 and repeating this procedure. This cooperation of the radius nut 118, the scope block 102 and the pivot nut 110 to lock the threaded stud of the sighting device 78 in a specific orientation relative to the scope block and the cooperation of the outer surfaces 103 and 106 of the scope block 102 and the internal surfaces of the aperture 98 of the horizontal slide 76 ensure that the sighting device maintains a consistent orientation even while the scope block 102 is repeatedly removed from the horizontal slide 76 and reinstalled in the horizontal slide 76.

While the detailed description of the exemplary embodiment describes a frame having radiused guide ways, it is appreciated by one of ordinary skill in the art that many other structures are contemplated within the scope of the present invention. The present invention merely requires that the bow sight enable the sight to traverse an arc having a radius that approximates the distance from the sight to an archer's eye when adjusting the sight for elevation.

Additionally, while the detailed description of the exemplary embodiment describes the cooperation between circumferential surfaces on a scope block and internal surfaces of a horizontal slide, one of ordinary skill in the art appreciates that other structures are intended to be included within the scope of the present invention. The present invention merely requires that two surfaces releasably mate to maintain a predetermined alignment between the sighting device and the bow.

It is also appreciated by those of ordinary skill in the art that, while this detailed description of the exemplary embodiment describes specific convex and concave surfaces mating with each other to selectively lock the sighting device in position with respect to the scope block, the present invention is not so limited to this description. Rather, the present invention merely requires that the structure of the bow sight provide that the sighting device may be selectively locked into position with respect to scope block.

While this invention has been described with the specific embodiments outlined above, many alternatives, modifications and variations are and will be apparent to those skilled in the art. Accordingly, the preferred embodiments described above are illustrative and not limiting. Various changes may be made without departing from the spirit and scope of the invention.

What is claimed is:

1. A bow sight comprising a curved frame having a center of curvature, means for affixing the frame to a bow, and an elevation block on which a sighting device is carried, the elevation block being adapted to travel along said frame on an arcuate path, the means for affixing the frame to the bow including a concentricity adjustment block on which said frame is mounted, said concentricity adjustment block including means permitting the center of curvature of the fame to be aligned vertically up and down to suit the eye position of an archers and set screw means locking the position of the concentricity adjustment block relative to the bow.

2. The bow sight of claim 1 wherein said frame has arcuate proximal and distal guideways and said elevation block has proximal and distal bearings that ride in the proximate and distal guideways, respectively.

3. The bow sight of claim 2 wherein a threaded rod is arranged in a void in said frame between the proximal and distal guideways thereof, said threaded rod having one end pivotally held at one end of the frame, and having a free end, and the threaded rod engaging said elevation block for adjusting the vertical position of the elevation block along said frame.

4. The bow sight of claim 1 wherein said frame is formed of an extruded member having a void defined between proximal and distal guideways, with a threaded rod being pivotally supported in said void.

5. A bow sight comprising a frame, means affixing the frame onto a bow, an elevation block slidably positioned on said frame and adapted to travel along said frame in an arcuate path having a center of curvature proximal of the bow, a horizontal slide carried on said elevation block and including means for adjusting the transverse position of the slide relative to the elevation block and a scope block that carries a sighting device and which is connected by a releasable engagement to said horizontal slide; wherein said slide has a horizontal receptacle aperture therethrough with a transverse axis in which said scope block is releasably held; and wherein said scope block has a circumferential surface that mates non-rotatably in said horizontal receptacle aperture.

6. The bow sight of claim 5 wherein said slide has a slot extending into said receptacle aperture, a threaded aperture that extends across said slot, and a threaded fastener in said threaded aperture which is rotatable to compress said slide against said sight block to lock it in place and to release the engagement of the sight block.

7. The bow sight of claim 5 wherein said threaded aperture is threaded on one side only of said slot.

8. The bow sight of claim 5 wherein said scope block circumferential surface and said slide horizontal receptacle aperture each have two or more flat surfaces that are angled with respect to one another.

9. The bow sight of claim 8 wherein said sight block has left and right ends that are respectively convex and concave, and has an internal aperture extending transversely therethrough; a threaded stud on one end of which the sighting device is mounted; the threaded stud passing through the internal aperture of the scope block; a convex nut on said stud having a convex surface engaging the concave end of the scope block, and a concave nut on said stud engaging the convex end of said scope block.

10. The bow sight claim 9 wherein the concave and convex ends of said scope block have a common center of curvature.

11. A bow sight comprising a frame, means affixing the frame onto a bow, an elevation block slidably positioned on said frame and adapted to travel along said frame, a horizontal slide carried on said elevation block and including means for adjusting the transverse position of the slide relative to the elevation block, and a scope block that cries a sighting device and which is connected by a releasable engagement to said horizontal slide; wherein said slide has a receptacle in which said scope block is releasably held; and wherein said scope block has left and right ends that are respectively convex and concave, and has an internal aperture extending transversely therethrough; a threaded stud on one end of which the sighting device is mounted; the threaded stud passing through the internal aperture of the scope block; a convex nut on said stud having a convex surface engaging the concave end of the scope block, and a concave nut on said stud engaging the convex end of said scope block.

12. The bow sight claim 11 wherein the concave and convex ends of said scope block have a common center of curvature.

13. A method of manufacture of a bow sight, comprising fabricating a curved frame for a bow sight, said fabricating including the steps of extruding an elongated member having a void extending axially therethrough such that the extruded elongated member completely surrounds the void; and machining arcuate guide rails into opposed outer surfaces of the elongated member to serve as proximal and distal guide rails; providing an elevation block that rides in the guide rails of the frame; mounting a sight block onto the elevation block; and mounting said frame onto a means for attaching the bow sight to a bow.

14. The method of claim 13, further comprising the steps of providing a threaded rod within said void of the curved fame, and pivotally supporting said threaded rod at one end of the frame, such that an end of the threaded rod is free; with said threaded rod passing threadably through said elevation block.

* * * * *

UNITED STATES PATENT AND TRADEMARK OFFICE

CERTIFICATE OF CORRECTION

PATENT NO. : 6,446,347 B1
DATED : September 10, 2002
INVENTOR(S) : Eric C. Springer It is certified that error appears in the above-identified patent and that said Letters Patent is hereby corrected as shown below:

Column 4,
Line 1, “ad” should read -- and --
Line 42, “look” should read -- lock --

Column 5,
Line 22, “sighing” should read -- sighting --
Line 41, “stud of” should read -- stud 79 of --

Column 6,
Line 23, “fame” should read -- frame --
Line 24, “archers” should read -- archer --

Column 7,
Line 18, “cries” should read -- carries --

Signed and Sealed this

Tenth Day of December, 2002

JAMES E. ROGAN
*Director of the United States Patent and Trademark Office*